US009581041B2

(12) United States Patent
Sinatra et al.

(10) Patent No.: US 9,581,041 B2
(45) Date of Patent: Feb. 28, 2017

(54) ABRADABLE CERAMIC COATINGS AND COATING SYSTEMS

(75) Inventors: Raymond J. Sinatra, Indianapolis, IN (US); Jesse S. Daugherty, Danville, IN (US); Marvin Alexander, Fishers, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1225 days.

(21) Appl. No.: 13/578,157

(22) PCT Filed: Feb. 9, 2011

(86) PCT No.: PCT/US2011/024177

§ 371 (c)(1),
(2), (4) Date: Nov. 29, 2012

(87) PCT Pub. No.: WO2011/100311

PCT Pub. Date: Aug. 18, 2011

(65) Prior Publication Data

US 2013/0108421 A1 May 2, 2013

Related U.S. Application Data

(60) Provisional application No. 61/302,856, filed on Feb. 9, 2010.

(51) Int. Cl.

| | |
|---|---|
| ***F01D 11/12*** | (2006.01) |
| ***F01D 25/00*** | (2006.01) |
| ***C23C 28/00*** | (2006.01) |

(52) U.S. Cl.

CPC ..... *F01D 25/00* (2013.01); *C23C 4/073* (2016.01); *C23C 28/321* (2013.01); (Continued)

(58) Field of Classification Search

CPC ..... F01D 11/412; F01D 11/122; F01D 5/005

See application file for complete search history.

(56) References Cited

U.S. PATENT DOCUMENTS 5,080,977 A 1/1992 Zaplatynsky
5,360,634 A 11/1994 Kamo
(Continued)

FOREIGN PATENT DOCUMENTS

EP 0117935 A1 9/1984
EP 0802172 A1 10/1997
(Continued)

OTHER PUBLICATIONS

Response to Office Action filed Oct. 18, 2012, from U.S. Appl. No. 12/624,836, filed Jan. 18, 2013, 13 pp.
(Continued)

*Primary Examiner* — Woody Lee, Jr.

(74) *Attorney, Agent, or Firm* — Shumaker & Sieffert, P.A.

(57) ABSTRACT

The disclosure relates to a high temperature mechanical system, such as a gas turbine engine, including a first coating deposited on a first substrate and a second coating deposited on a second substrate. The first coating includes a first bond layer, a second bond layer, and a first ceramic outer layer, wherein the second bond layer is between the first bond layer and first ceramic outer layer. The second coating includes a third bond layer deposited on the substrate and a second ceramic outer layer deposited on the third bond layer. The second coating is configured to abrade the first coating, e.g., during operation of the high temperature mechanical system.

18 Claims, 4 Drawing Sheets

(52) U.S. Cl.
CPC ..... *C23C 28/325* (2013.01); *C23C 28/3215* (2013.01); *C23C 28/345* (2013.01); *C23C 28/3455* (2013.01); *F01D 11/122* (2013.01)

(56) References Cited

U.S. PATENT DOCUMENTS

| | | | | |
|---|---|---|---|---|
| 5,704,759 | A * | 1/1998 | Draskovich | F01D 11/122 415/170.1 |
| 5,863,668 | A * | 1/1999 | Brindley | C23C 4/02 416/241 B |
| 6,376,015 | B1 | 4/2002 | Rickerby | |
| 7,374,825 | B2 * | 5/2008 | Hazel | C23C 28/321 416/241 B |
| 7,473,072 | B2 * | 1/2009 | Malak | C23C 28/00 415/173.4 |
| 2002/0197155 | A1 | 12/2002 | Howard et al. | |
| 2003/0138658 | A1 | 7/2003 | Taylor et al. | |
| 2003/0211354 | A1 * | 11/2003 | Subramanian | C23C 4/04 428/633 |
| 2006/0099358 | A1 | 5/2006 | Raybould et al. | |
| 2006/0115659 | A1 | 6/2006 | Hazel et al. | |
| 2008/0044686 | A1 | 2/2008 | Schlichting et al. | |
| 2008/0145629 | A1 * | 6/2008 | Anoshkina | C23C 30/00 428/213 |
| 2009/0123722 | A1 | 5/2009 | Allen et al. | |

FOREIGN PATENT DOCUMENTS

| | | | |
|---|---|---|---|
| EP | 0916635 | A2 | 5/1999 |
| JP | 06087673 | A | 3/1994 |
| JP | 07025670 | A | 1/1995 |

OTHER PUBLICATIONS

Office Action from U.S. Appl. No. 12/624,836, dated Mar. 1, 2013, 10 pp.

Response to Final Office Action dated Mar. 1, 2013, from U.S. Appl. No. 12/624,836, filed May 3, 2013, 11 pp.

Response to Final Office Action dated Mar. 1, 2013, and Advisory Action dated May 10, 2013, from U.S. Appl. No. 12/624,836, filed Jun. 3, 2013, 11 pp.

Office Action from U.S. Appl. No. 12/624,836, dated Jul. 3, 2013, 10 pp.

Response to Office Action dated Jul. 3, 2013, from U.S. Appl. No. 12/264,836, filed Oct. 3, 2013, 8 pp.

Office Action from U.S. Appl. No. 12/624,836, dated Oct. 18, 2012, 9 pp.

Baril et al., "Evaluation of SiC Platelets as a Reinforcement for Oxide Matrix Composites," Ceramic Engineering and Science Proceedings, vol. 12, No. 7-8, pp. 1175-1192, 1991.

Dittrich et al., "Fiber-reinforced ceramic coatings and free-molded ceramics by thermal spraying" Werkstoff-und Verfahrenstechnik, Symposium 6, Werkstoffe, '96, Stuttgart 1996 (1997), Meeting Date 1996, English translation of summary only.

International Search Report and Written Opinion for corresponding international application No. PCT/US2011/024177, dated May 18, 2011, 15 pp.

International Preliminary Report on Patentability for corresponding international application No. PCT/US2011/024177, dated Aug. 23, 2012, 10 pp.

Office Action from U.S. Appl. No. 12/624,836, dated Oct. 24, 2013, 9 pp.

* cited by examiner

ABRADABLE CERAMIC COATINGS AND COATING SYSTEMS

This application is a 371 national stage entry of PCT Application No. PCT/US2011/024177, filed Feb. 9, 2011, which claims the benefit of U.S. Provisional Application No. 61/302,856, filed Feb. 9, 2010, the entire content of which is incorporated herein by reference.

TECHNICAL FIELD

The disclosure relates to coatings for use in high temperature mechanical systems.

BACKGROUND

The components of high-temperature mechanical systems, such as, for example, gas-turbine engines, must operate in severe environments. For example, hot section components of gas turbine engines, e.g., turbine blades and/or vanes, exposed to hot gases in commercial aeronautical engines may experience surface temperatures of greater than 1,000° C. Economic and environmental concerns, i.e., the desire for improved efficiency and reduced emissions, continue to drive the development of advanced gas turbine engines with higher gas inlet temperatures. As the turbine inlet temperature continues to increase, there is a demand for components capable of operating at such high temperatures.

Components of high-temperature mechanical systems may include ceramic and/or superalloy substrates. Coatings for such substrates continue to be developed to increase the operating capabilities of such components and may include thermal barrier coatings (TBC) and environmental barrier coatings (EBC). In some examples, thermal barrier coatings (TBC) may be applied to substrates to increase the temperature capability of a component, e.g., by insulating a substrate from a hot external environment. Further, environmental barrier coatings (EBC) may be applied to ceramic substrates, e.g., silicon-based ceramics, to provide environmental protection to the substrate. For example, an EBC may be applied to a silicon-based ceramic substrate to protect against the recession of the ceramic substrate resulting from operation in the presence of water vapor in a high temperature combustion environment. In some cases, an EBC may also function as a TBC, although a TBC may also be added to a substrate in addition to an EBC to further increase the temperature capability of a component.

SUMMARY

In general, the disclosure relates to coatings that may be applied to components of high temperature mechanical systems, including components of gas turbine engines. In some embodiments, the coatings may include one or more ceramic layers bonded to a substrate via one or more metallic bond coats. In this aspect, such coatings may be referred to in this disclosure as ceramic coatings despite the fact that the coating may also include one or more non-ceramic layers, such a metallic bond layers. The ceramic coating may provide thermal protection, e.g., as a TBC, to the components to which the coatings are applied during operation of the gas turbine engine.

A first ceramic coating may be applied to a first component or surface of a gas turbine engine and a ceramic coating may be applied to a second component or surface of the gas turbine engine. During operation of the gas turbine engine of first, the respective coatings may come into contact with another, and the first ceramic coating may be configured to be abraded or eroded by the contact with the second ceramic coating. The abrasive interaction between the respective ceramic coatings may provide for an intimate fit between the opposing components surfaces while also providing suitable thermal protection to the components during operation of a high temperature mechanical system, such as a gas turbine engine.

In one embodiment, the disclosure is directed to a system comprising a first coating deposited on a first substrate, the first coating comprising a first bond layer, a second bond layer, and a first ceramic outer layer, wherein the second bond layer is between the first bond layer and first ceramic outer layer; and a second coating deposited on a second substrate, the second coating comprising a third bond layer deposited on the substrate and a second ceramic outer layer deposited on the third bond layer, wherein the second coating is configured to abrade the first coating.

In another embodiment, the disclosure is directed to a method comprising forming a first coating on a first substrate, the first coating comprising a first bond layer, a second bond layer, and a first ceramic outer layer, wherein the second bond layer is between the first bond layer and first ceramic outer layer; and forming a second coating on a second substrate, the second coating comprising a third bond layer deposited on the substrate and a second ceramic outer layer deposited on the third bond layer, wherein the respective coating are configured such that the second coating at least partially abrades the first coating when brought into to contact with one another.

In another embodiment, the disclosure is directed to a multilayer coating comprising a first bond layer having a first porosity on a substrate; a second bond layer having a second porosity greater than the first porosity on the first bond layer; and a ceramic outer layer formed on the second bond layer.

The details of one or more embodiments of the invention are set forth in the accompanying drawings and the description below. Other features, objects, and advantages of the invention will be apparent from the description and drawings, and from the claims.

DETAILED DESCRIPTION

Figure 1A:
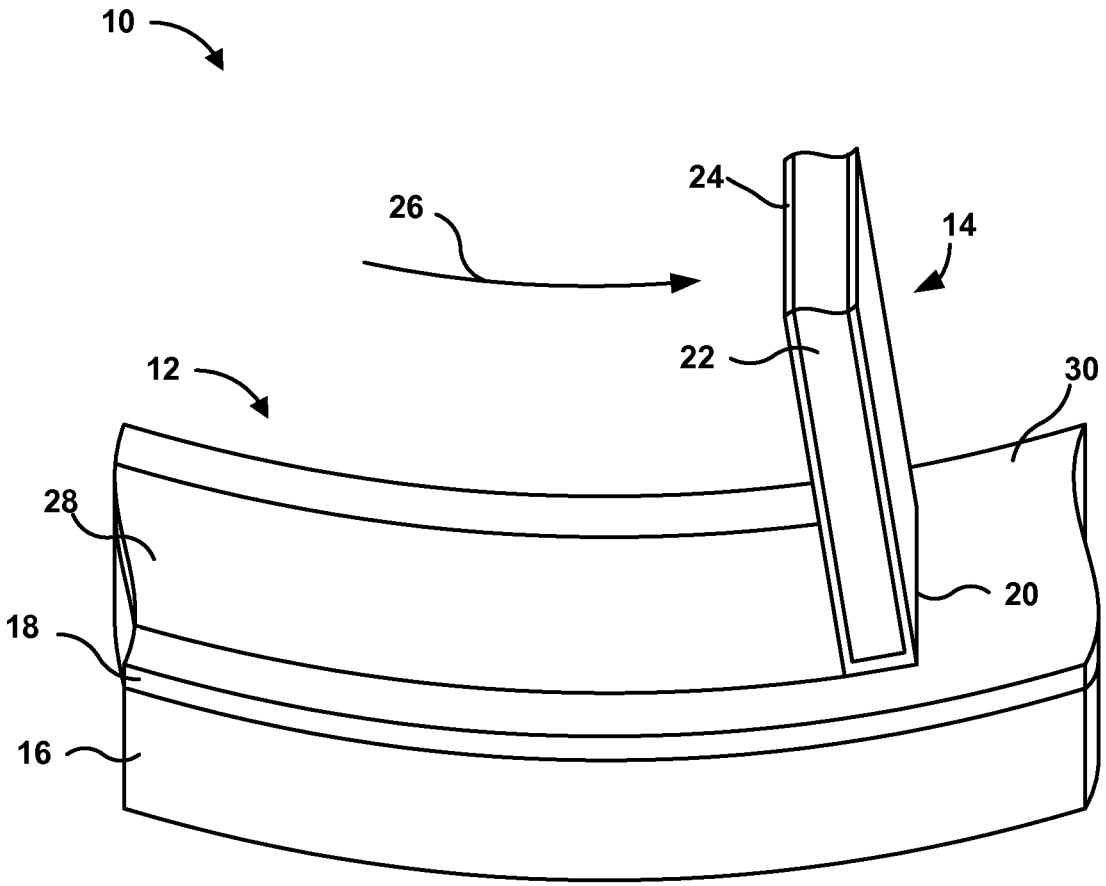
FIG. 1A is a cross-sectional diagram illustrating a portion of an example gas turbine engine including a gas turbine blade track and a gas turbine blade.

In general, the disclosure relates to coatings that may be applied to components of high temperature mechanical systems, including components of gas turbine engines. In some embodiments, the coatings may include one or more ceramic layers bonded to a substrate via one or more metallic bond coats. In this aspect, such coatings may be referred to in this disclosure as ceramic coatings despite the fact that the coating may also include one or more non-ceramic layers, such as metallic bond layers.

Components of high-temperature mechanical systems may include superalloy substrates, such as, e.g., Ni- or Co-based super alloy substrates. As previously described, to reduce surface temperatures of the components during operation of the mechanical systems, these superalloy substrates can be coated with a ceramic coating that functions as a thermal barrier coating (TBC). While embodiments of the disclosure may be described with respect to ceramic coatings that may be applied to superalloy substrates to provide thermal protection to a substrate, it is appreciated that such coating may also be applied to non-super alloy substrates, such as, e.g., silicon-based ceramic substrates. In such cases, the coating may also function as an environmental barrier coating (EBC) at least to the extent the coating provides some degree of environmental protection to the substrate, in addition to functioning as a TBC.

By coating a component of a high temperature mechanical system with such a TBC, the maximum temperature at which the components of the mechanical system may operate may be increased, including an increase in gas inlet temperatures. In this manner, coating a component with a TBC may facilitate an increase in the power and/or efficiency of a gas turbine engine.

In addition to increasing the gas inlet temperature that components of a gas turbine can operate, gas turbine power and efficiency may also be improved by reducing the gap between a gas turbine blade and a surrounding blade track or blade shroud. One method of reducing the gap between blade and track or shroud includes coating the blade track or blade shroud with an abradable coating. As the turbine blade rotates, the tip portion of the turbine blade intentionally contacts the abradable coating on the opposing surface and wears away a portion of the coating to form a groove in the abradable coating corresponding to the path of the turbine blade. The intimate fit between the blade and abradable coating provides a seal, which may reduce or eliminate leakage of gas around the blade tip and increase the efficiency of the gas turbine engine by up to or even greater than 5 percent in some cases.

However, while ceramic coating may provide a desirable amount of thermal protection, the ceramic coatings may have issues adhering to superalloy substrates, especially in high temperature operating environments and/or at thicknesses that are typically desirable for abradable coatings and the ceramic outer layers of the abradable coating. In some cases, the distance between the surface of the blade track and tip of a turbine blade may vary during the turbine operation due to a number of factors, such as, e.g., thermal expansion and/or component manufacturing variations. Accordingly, to account for this distance variation, it may be desirable for the ceramic outer layer of an abradable coating to have, at a minimum, a thickness that substantially corresponds to the maximum and minimum separation of the blade tip from the blade track surface experienced during operation. In such a configuration, an abraded path in the coating and ceramic layer, in particular, on the blade track may be formed such that an intimate fit is formed between the tip and track throughout operation of the turbine while still maintaining an adequate thermal barrier via the ceramic outer layer. However, such limitations require relatively thick ceramic coatings. At such coating thicknesses, a ceramic outer layer and/or of layers of the ceramic coating may not adequately adhere to the surface of the component, causing delamination of the coating from the component and potential failure of the thermal barrier coating.

As will be described further below, some embodiments of the disclosure relate to coatings having one or more ceramic layers that may be applied to components of high temperature mechanical, e.g., components includes superalloy substrates, in a manner that provides adequate thermal protection to the component. In some case, the ceramic coating may be provided as an abradable coating that may coated on one or more components of high temperature mechanical systems, as described herein.

The ceramic coatings may include one or more bond layers that may promote adherence of the ceramic outer layers to the substrate, even at thicknesses that would typically be incompatible with ceramic coatings on superalloy substrates. The one or more bond layers may be metallic bond layers. For example, the coating may include one or more bond layers comprising one or more MCrAlY alloys, where M is Ni, Co, or NiCo. The one or more bond coats may be applied in a manner such that the ceramic outer layer adequately adheres to a super alloy substrate in a high temperature mechanical system even in cases when the coating is relatively thick and abradable. For example, the combination of bond layers and ceramic outer layers may facilitate coating thicknesses consistent with the variations in the distance between a blade tip surface and a blade track of a turbine engine, as previously described, while still exhibiting adequate adherence of the coating to the substrate.

In some embodiments, such ceramic coatings may be applied to multiple components and/or surfaces of a high temperature mechanical system to provide an abradable coating system. For example, the coatings may be applied to the one or more surfaces of respective components in a high temperature mechanical system that oppose one another in operation and may contact into contact with one another when moving relative to each other. When the outer surface of one substrate is moved relative to the opposing outer surface while in contact with the opposing surface, the ceramic coating may be abraded as a result of the interaction. The ceramic coating may continue to be abraded until the opposing surface is no longer in contact with the abradable ceramic coating.

Such an abrasive coating system may include first and second ceramic coatings in which the second ceramic coating is configured to abrade the first ceramic coating. The second ceramic coating may be referred to as an abrasive ceramic coating and the first coating may be referred to as an abradable ceramic coating. As will be described herein, the abrasive coating system may be provided on respective superalloy components of a gas turbine engine to improve the performance of the turbine engine.

For example, as will be described with respect to FIGS. 1A-1C, a gas turbine blade track may be coated with a first ceramic coating and the tip of a turbine blade that follows that blade track may be coated with a second ceramic coating. In each case, the respective ceramic coatings may include a ceramic outer layer that is adhered to the superalloy component via one or more bond layers. The first and second ceramic coatings may be configured such that the coated blade tip may abrade or "rub" the first ceramic coating of the blade track when the blade tip contacts the surface of the first coating when rotating within the blade track. During operation of the gas turbine engine, the blade tip may wear away a portion of the first coating corresponding to the path of the blade tip within the blade track until an intimate fit is formed between the respective components. In this manner, the gap between the gas turbine blade tip and surrounding blade track may be minimized, which may increase both the power and efficiency of the associated gas turbine engine.

FIG. 1A is a conceptual diagram illustrating a portion of an example gas turbine engine 10 including gas turbine blade track or gas turbine blade shroud 12 (hereinafter "gas turbine blade track 12") and gas turbine blade 14. Gas turbine blade track 12 includes substrate 16 and first coating 18 deposited on substrate 16. Gas turbine blade 14 and gas turbine blade tip 20, in particular, includes substrate 22 and second coating 24 deposited on substrate 20. The configuration of first coating 18 deposited on substrate 16 and second coating 24 deposited on substrate 22 is described in further detail below with respect to FIGS. 1B and 1C, respectively.

During operation of gas turbine engine 10, gas turbine blade 14 rotates relative to blade track 12 in a direction indicated by arrow 26. Second coating 22 on blade tip 20 may contact first coating 18 and abrade a portion of first coating 18 to form a groove 28 into surface 30 of first coating 18 of blade track 12. The depth of groove 28 corresponds to the extent that blade 14 extends into first coating 18. The depth of groove 28 may not be constant, as variations in fit between blade track 12 and turbine blade 14 may exist along the length of blade track 12.

Of course, in actual gas turbine engines, more than one blade is typically used. The gas turbine blades may follow substantially the same path along blade track 12 as the blades rotate during operation. However, the turbine blades may vary slightly in length or alignment, and thus may abrade different portions of first coating 18. Accordingly, groove 28 may be essentially a superposition of the grooves formed by each turbine blade 14. Because of this, the seal between a turbine blade 14 and first layer 18 may not be perfect but may be improved compared to a seal between a turbine blade 14 and blade track 12 that does not include first coating 18 and/or second coating 24.

Figure 1B:
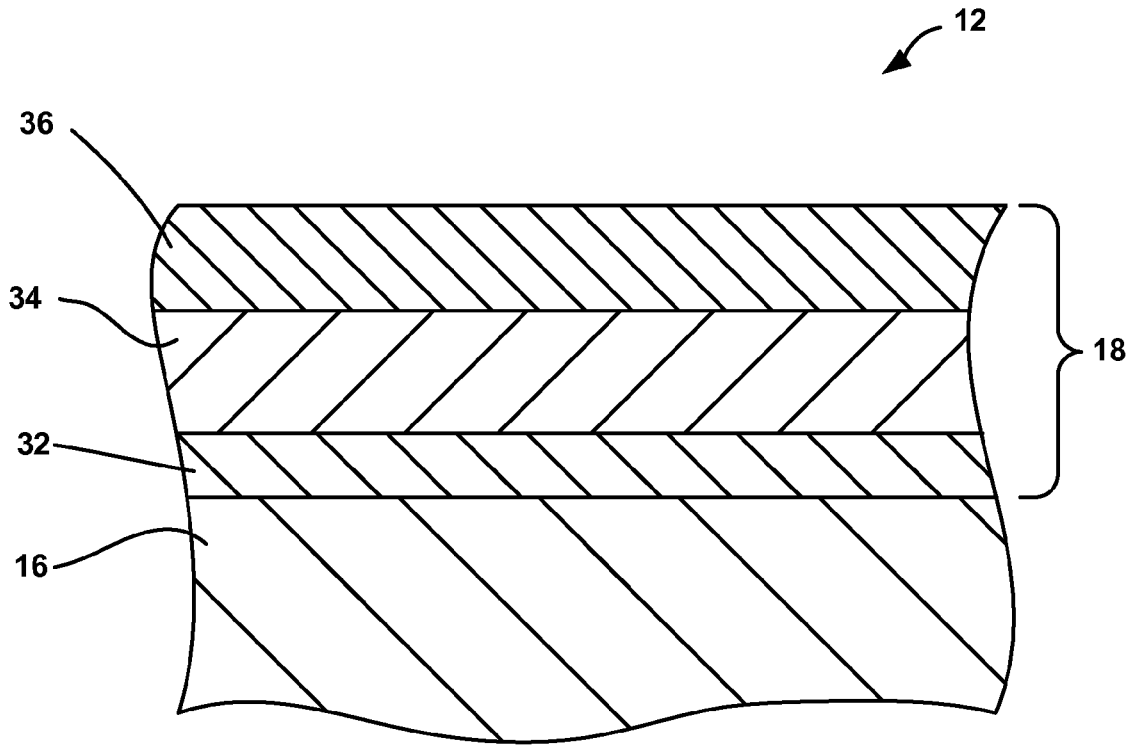
FIG. 1B is a cross-sectional diagram illustrating a portion of the example gas turbine blade track of FIG. 1A.

FIG. 1B is a cross-sectional diagram illustrating a portion of blade track 12 shown in FIG. 1A. Blade track 12 is an article that includes substrate 16 coated with first coating 18. While first coating 18 is described with respect to substrate 14 of blade track 12, such an article may be any appropriate article including one or more components of a high temperature mechanical system. Moreover, while the embodiments described herein are directed primarily to a gas turbine blade track, it will be understood that the disclosure is not limited as such. Rather, first coating 18 may be deposited over any substrate which requires or may benefit from the application of first coating 18. For example, first coating 18 may be deposited on a cylinder of an internal combustion engine, an industrial pump, a housing or internal seal ring of an air compressor, or an electric power turbine.

In some embodiments, substrate 16 may include a superalloy, such as a superalloy based on Ni, Co, Ni/Fe, or the like. A substrate 16 including a superalloy may include other additive elements to alter its mechanical properties, such as toughness, hardness, temperature stability, corrosion resistance, oxidation resistance, and the like, as is well known in the art. Any useful superalloy may be utilized for substrate 16, including, for example, those available from Martin-Marietta Corp., Bethesda, Md., under the trade designation MAR-M247; those available from Cannon-Muskegon Corp., Muskegon, Mich., under the trade designation CMSX-3, CMSX-4, or CMXS-10; and the like.

In other embodiments, substrate 16 may include a ceramic or ceramic matrix composite (CMC), although a change in bond-type chemistry and/or surface preparation from that used for superalloy substrates may be necessary for ceramic or CMC substrates. A substrate 16 including a ceramic or CMC may include any useful ceramic material, including, for example, silicon carbide, silicon nitride, alumina, silica, and the like. The CMC may further include any desired filler material, and the filler material may include a continuous reinforcement or a discontinuous reinforcement. For example, the filler material may include discontinuous whiskers, platelets, or particulates. As another example, the filler material may include a continuous monofilament or multifilament weave.

The filler composition, shape, size, and the like may be selected to provide the desired properties to the CMC. For example, the filler material may be chosen to increase the toughness of a brittle ceramic matrix. The filler may also be chosen to modify a thermal conductivity, electrical conductivity, thermal expansion coefficient, hardness, or the like of the CMC.

In some embodiments, the filler composition may be the same as the ceramic matrix material. For example, a silicon carbide matrix may surround silicon carbide whiskers. In other embodiments, the filler material may include a different composition than the ceramic matrix, such as aluminum silicate fibers in an alumina matrix, or the like. One preferred CMC includes silicon carbide continuous fibers embedded in a silicon carbide matrix.

Some example ceramics and CMCs which may be used for substrate 16 include ceramics containing Si, such as SiC and $Si_3N_4$; composites of SiC or $Si_3N_4$ and silicon oxynitride or silicon aluminum oxynitride; metal alloys that include Si, such as a molybdenum-silicon alloy (e.g., $MoSi_2$) or niobium-silicon alloys (e.g., $NbSi_2$); and oxide-oxide ceramics, such as an alumina or aluminosilicate matrix with a NEXTEL™ Ceramic Oxide Fiber 720 (available from 3M Co., St. Paul, Minn.).

As shown in FIG. 1B, first coating 18 is deposited on surface of substrate 16. As used herein, "deposited on" is defined as a layer or coating that is deposited on top of another layer or coating, and encompasses both a first layer or coating deposited immediately adjacent a second layer or coating and a first layer or coating deposited on top of a second layer or coating with one or more intermediate layer or coating present between the first and second layers or coatings. In contrast, "deposited directly on" denotes a layer or coating that is deposited immediately adjacent another layer or coating, i.e., there are no intermediate layers or coatings.

First coating 18 includes first bond layer 32, second bond layer 34, and ceramic outer layer 36. First bond layer 32 and second bond layer 34 may be metallic bond layers and may comprise at least one of an MCrAlY alloy (where M is Ni, Co, or NiCo), a β-NiAl nickel aluminide alloy, a γ-Ni+γ'-$Ni_3Al$ nickel aluminide alloy, or the like. In some embodiments, first bond layer 32 and second bond layer 34 may have substantially similar compositions. For example, in some cases, first and second bond layers 32 and 34 may each comprise a CoNiCrAlY alloy. In others embodiments, first bond layer 32 and second bond layer 34 may have different compositions, e.g., first bond layer 32 may comprise a CoNiCrAlY alloy, while second bond layer 34 may comprise a NiCrAlY alloy.

Ceramic outer layer 36 may comprise one or more suitable ceramic materials. For example, ceramic outer layer 36 may comprise one or more of aluminum oxide, zirconium oxide, magnesium oxide, and the like. Ceramic outer layer 36, in combination with first and second bond layer 32 and 34, may provide thermal protection to substrate 16, as previously described. In some cases, ceramic outer layer 36 may include other elements or compounds to modify a desired characteristic of the ceramic outer layer 36, such as, for example, phase stability, thermal conductivity, or the like. Exemplary additive elements or compounds include, for example, rare earth oxides.

As shown, first and second bond layers 32 and 34 separate ceramic outer layer 36 from substrate 16. In this manner, first and second bond layers 32 and 34 may function in adhere ceramic outer layer 36 to substrate 16. As will be described in greater detail below, the composition and properties, e.g., density, porosity, thickness, and the like, of first bond layer 32, second bond layers 34, and ceramic outer layer 36 may be tailored to provide suitable adhesion between adjacent layers and to substrate 16 with relatively thick layers, while also providing adequate thermal and oxidation protection to substrate 16. The properties and microstructure of first and second bond layer 32 and 34 may be tailored to provide oxidative protection to substrate 16 while also adhering ceramic outer layer 36 to substrate 16 to provide thermal protection. Moreover, the microstructure and properties, e.g., thickness and hardness, of ceramic outer layer 36 may be tailored such that it may be abraded by second coating 22 (FIG. 1A) during operation of turbine engine 10 while maintaining the mechanical integrity and adequate thermal protection.

Each of first bond layer 32, second bond layer 34, and ceramic outer layer 36 may be formed on substrate 16 by depositing appropriate material, typically in the form of a powder, onto the outer surface of article 12. In some cases, the outer surface of article 12 may be prepared prior to the deposition of the appropriate material to form the adjacent layer. For example, the surface of substrate 16 may be prepared via grit blasting, or may be patterned or etched prior to the deposition of first bond layer 32. Preparation of the surface of substrate 16 may improve adhesion between first bond layer 32 and substrate 16 by compartmentalizing the strain on the interface between first bond layer 32 and substrate 16 due to any thermal expansion coefficient mismatch between first bond layer 32 and substrate 16. A patterned surface may include a pattern that extends in substantially one dimension along surface of substrate 16, such as an array of parallel grooves or ridges, or may include a pattern that extends in two dimensions along surface 16, such as an array of parallel lines extending in two or more directions and forming an array of rectangles, triangles, diamonds, or other shapes.

First bond layer 32, second bond layer 34, and ceramic outer layer 36 may be applied to substrate 16 via any suitable technique, including, e.g., high velocity oxygen fuel thermal spraying, plasma spraying, electron beam physical vapor deposition, chemical vapor deposition, and the like. Notably, the particular spray technique, the spray parameters of the respective technique, and/or the particle size of the material deposited to form each respective layer may be tailored or selected in such a manner that each of layers 32, 34, and 36 exhibit one or more suitable properties and microstructure, such as that described above. For example, the porosity and/or hardness of first bond layer 32, second bond layers 32 and/or ceramic outer layer 36 may be tailored such that first coating 18 functions as an abradable coating that provides suitable thermal protection to substrate 16, while also adequately adhering to substrate 16 during operation in a high temperature environment.

First bond layer 32 may be formed by depositing relatively fine mesh metallic powder onto substrate 16 via high velocity oxygen fuel thermal spraying. For example, the particle size of the metallic powder deposited to form first bond layer 32 may range from approximately −150 mesh to approximately −325 mesh, such as, approximately −170 mesh to approximately +325 mesh. In some examples, first bond layer 32 may be formed by depositing metallic powder having approximately −325 mesh particle size, such as, e.g., approximately −325 mesh CoCrAlY, onto substrate 16 via high velocity oxygen fuel thermal spraying.

Using such a process to apply first bond layer 32, first bond layer 32 may be formed such first bond layer 32 exhibits a suitable porosity and provides suitable oxidation protection at the temperatures at which gas turbine engine 10 operates, while also permitting relatively thick coating buildup due to the low internal coating stresses. For example, the layer thickness of first bond layer 32 may be between approximately 15 mils and approximately 50 mils, such as, e.g., approximately 26 mils to approximately 29 mils.

With regard to the porosity of first layer 32, in some embodiments, first bond layer 32 may have a porosity that ranges from approximately 1 percent to approximately 10 percent, such as, e.g., approximately 2 percent to approximately 5 percent. In some cases, first bond layer 32 may exhibit a porosity that is less than the porosity of second bond layer 34. For example, the first porosity may be between approximately 5 percent and approximately 20 percent less than the second porosity, such as, e.g., between approximately 10 percent and approximately 15 percent less than the second porosity.

Second bond layer 34 may be formed by depositing a relatively coarse mesh metallic powder, or at least a coarse powder relative to the powder used form first bond layer 32. For example, the particle size of the metallic powder deposited to form second bond layer 32 may range from approximately −140 to approximately −325, such as, approximately −200 to approximately +325. In some examples, second bond layer 34 may be formed by depositing metallic powder having approximately +225 mesh particle size, such as, e.g., approximately +225 mesh CoCrAlY, onto first bond layer 32 via plasma spraying. In some examples, increasing the particle size used for second bond layer 34 improves adhesion of ceramic outer layer 36.

As previously described, second bond layer 34 may be deposited such the porosity of second bond layer 34 is greater than that of first bond layer 32. Second bond layer 34 may have a porosity that ranges from approximately 10 percent to approximately 30 percent, such as, e.g., approximately 15 percent to approximately 25 percent. Moreover, to promote adhesion between second bond layer 34 and ceramic outer layer 36, second bond layer 34 may be deposited to exhibit a relatively rough surface profile. In some examples, the second bond layer may exhibit a surface roughness of approximately 350 to approximately 400 microinches. The layer thickness of second bond layer 34 may be between approximately 2 mils and approximately 15 mils, such as, e.g., approximately 3 mils to approximately 6 mils.

Once second bond layer 34 has been formed on first bond layer 32, ceramic outer layer 36 may be applied onto second bond layer 34 via any suitable technique including, for example, high velocity oxygen fuel thermal spraying, plasma spraying, electron beam physical vapor deposition, chemical vapor deposition, and the like. The ceramic powder size and/or spray process parameters of a particular technique may be specifically tailored to form a ceramic outer layer 36 that is relatively porous and has a relatively low hardness value, e.g., a layer that has a hardness less than that of the hardness of the ceramic outer layer of second coating 24 (FIGS. 1A and 1C). Example particles sizes may vary depending on particular ceramic materials, but may range from approximately −240 to approximately −270. Example deposition process parameters that may be tailored to provide a suitable ceramic outer layer are generally known in the art, and may include powder feed rate, stand-off distance, and the like.

In some embodiments, ceramic outer layer 36 may have a porosity greater than approximately 25 percent, such as, e.g., greater than approximately 40 percent. In some examples, ceramic outer layer 36 may have a porosity between about 25 percent and about 50 percent, such as, e.g., between about 40 percent and about 50 percent. The porosity of ceramic outer layer 36 may be dependent on the relatively hardness and/or porosity of the surface configured to abrade first coating 34, as described herein. For example, the porosity of ceramic outer layer 40 of second coating 24 on blade tip 20 (FIGS. 1A and 1C) may be less than the porosity of ceramic outer layer 36 of first coating 18. In this manner, ceramic outer layer 36 may provide for suitable thermal protection for substrate 16, while also allowing ceramic outer layer 36 to be abraded when contacted by second coating 24 on blade tip 20 (FIG. 1A) to provide for an improved seal between turbine track 12 and turbine blade 14. In some examples, ceramic outer layer 36 may have a hardness between approximately 35 to approximately 45 Rockwell hardness (Rc).

Ceramic outer layer 36 may have any layer thickness that provides adequate thermal protection to substrate 16 while also suitably adhering to substrate 16 via first and second bond layers 32 and 34. To some extent, the degree of thermal protection provided by ceramic outer layer 36 and first ceramic coating 18 increases as the thickness of ceramic outer layer 36. In some embodiments, the thickness of ceramic outer layer 36 may be greater than approximately 30 mils. As will be described in greater detail below, in configurations such as that shown in FIG. 1A, ceramic outer layer 36 may be have a thickness that allows second coating 24 to abrade into the surface of ceramic outer layer 36 during operation of turbine engine 10 without contacting second bond layer 34. In this manner, ceramic outer layer 36 may be abraded to some extent by second coating 24 while still providing thermal protection to substrate 16.

Accordingly, by applying bond layers 32 and 34, and ceramic outer layer 36 on substrate 16 consistent with that described herein, first coating 18 may form a relatively thick ceramic coating on substrate 16 that provides suitable thermal protection despite that fact that it may be abraded when brought into contact with second coating 24 on blade tip 20 during operation of gas turbine engine 10. In some embodiments, first coating 18 may have a thickness greater than approximately 50 mils. In some embodiments, first coating 18 may have a thickness of between approximately 20 mils and approximately 50 mils, such as, e.g., between 25 mils and 30 mils.

Figure 1C:
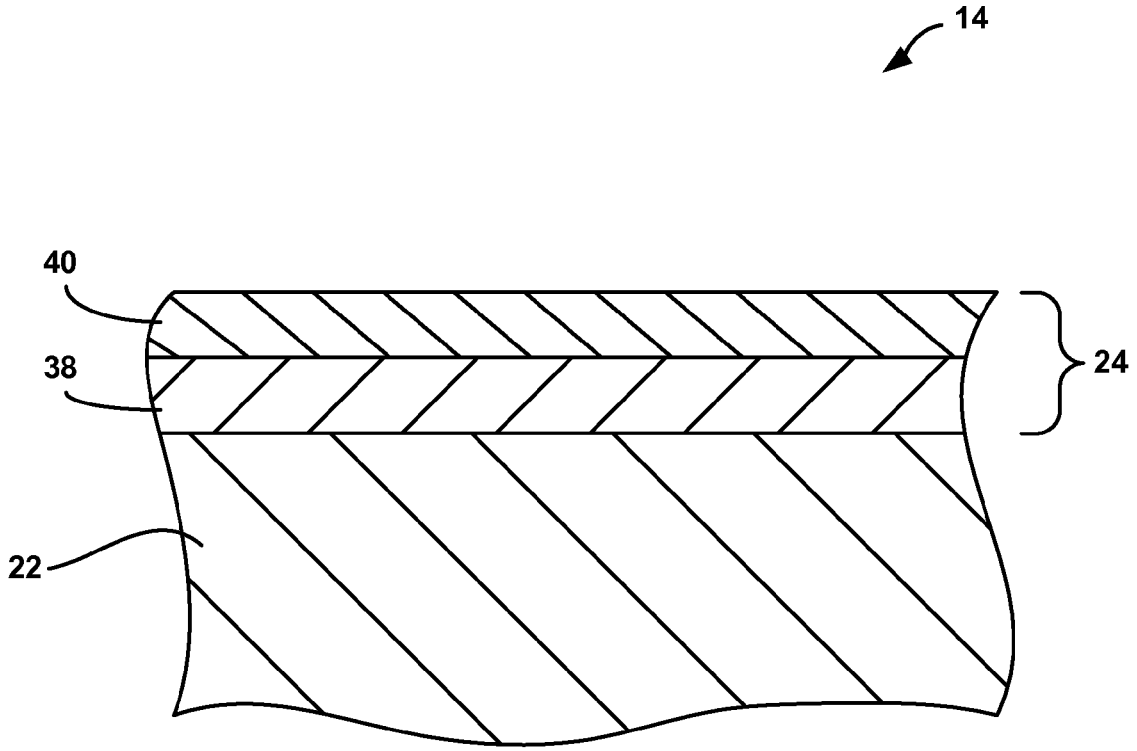
FIG. 1C is a cross-sectional diagram illustrating a portion of the example gas turbine blade of FIG. 1A.

FIG. 1C is a cross-sectional diagram illustrating a portion of turbine blade 14 shown in FIG. 1A and, more precisely, may illustrate blade 20 of turbine blade 14. Turbine blade 14 is an article that includes substrate 22 coated with second coating 24. While second coating is described with respect to substrate 22 of blade 14, such an article may be any appropriate by any appropriate article including one or more components of a high temperature mechanical system. Moreover, while the embodiments described herein are directed primarily to a gas turbine blade, it will be understood that the disclosure is not limited as such. Rather, second coating 24 may be deposited over any substrate which requires or may benefit from the application of second coating 24. For example, second coating 24 may be deposited on a cylinder of an internal combustion engine, an industrial pump, a housing or internal seal ring of an air compressor, or an electric power turbine.

Substrate 22 may be substantially the same or similar to that previously described with respect to substrate 14. For example, substrate 22 may include a superalloy, a ceramic or ceramic matrix composite. As the blade track 12 and blade 14 may be components of the same high temperature mechanical system, substrates 14 and 22 may be substantially the same as one another, e.g., both including the superalloys, although embodiments are not limited to such configurations.

Second coating 24 is deposited on substrate 22 and includes third bond layer 38 and second ceramic outer layer 40, and may provide thermal protection to substrate 22 during operation in high temperature environments. As configured, second ceramic outer layer 38 is adhered to substrate 22 via third bond layer 40, and may abrade first coating 18 on first substrate 16 (FIGS. 1A and 1B) during operation of gas turbine engine 10 (FIG. 1A).

Similar to that to first and second bond layers 32 and 34, third bond layer 38 may be a metallic bond layer and may comprise at least one of an MCrAlY alloy (where M is Ni, Co, or NiCo), a β-NiAl nickel aluminide alloy, a γ-Ni+γ'-$Ni_3Al$ nickel aluminide alloy, or the like. Third bond layer 38 may be applied on substrate 22 via any suitable technique, including, e.g., high velocity oxygen fuel thermal spraying, plasma spraying, electron beam physical vapor deposition, chemical vapor deposition, and the like. Furthermore, the particle size of the material being deposited to form third bond layer 38 may be selected to provide a bond layer having suitable properties, including, e.g., a suitable porosity and/or density. In some embodiments, a relatively coarse metallic powder, such as, e.g., relatively coarse CoNiCrAlY powder, may be deposited via plasma spraying to form third bond layer 38. In some embodiments, the particle size of the metallic powder deposited to form third bond layer 38 may range from approximately −140 to approximately −325 mesh, such as, approximately −200 mesh to approximately +325 mesh. Moreover, in some embodiments, the thickness of third bond layer 38 may range from approximately 2 mils to approximately 20 mils, such as, e.g., approximately 3 mils to approximately 6 mils.

Similar to ceramic outer layer 36 of first coating 18, second ceramic outer layer 40 may comprise one or more suitable ceramic materials. For example, ceramic outer layer 36 may comprise one or more of aluminum oxide, zirconium oxide, and the like. In some embodiments, second ceramic outer layer 40 may have a composition substantially similar to that of ceramic outer layer 36, while in other embodiments the compositions of the respective ceramic outer layers may be different from one another.

Also, similar to that of ceramic outer layer 36, second ceramic outer layer 40 may be applied on third bond layer 38 via any suitable technique, e.g., high velocity oxygen fuel thermal spraying, plasma spraying, electron beam physical vapor deposition, chemical vapor deposition, and the like. However, the particle size of the material deposited on third bond layer 38 and/or the spray parameters may be selected such that second ceramic outer layer 36 is relatively dense and hard compared to that of ceramic outer layer 36 of first coating 18. By forming a ceramic coating that is relatively dense and hard compared to ceramic outer layer 36 of first coating 18, second ceramic outer layer 40 may abrade the first coating 18, and first ceramic outer layer 36, in particular.

For example, second ceramic outer layer 40 may have a porosity that is less than that of the porosity of first ceramic outer layer 36 (FIG. 1B). In some embodiments, depending in part of the porosity of first ceramic outer layer 36, the porosity of second ceramic outer layer may be less than approximately 15 percent, such as, e.g., less than approximately 6 percent. At such low porosities, second ceramic outer layer 40 may successfully abrade or erode the first ceramic outer layer 36 during operation of gas turbine engine 10 (FIG. 1A). The thickness of second ceramic outer layer may range from approximately 5 mils to approximately 15 mils, such as, approximately 7 mils to approximately 12 mils.

As described, second coating 24 may abrade first coating 18 during operation of gas turbine engine 10 (FIG. 1A). Referring again to FIG. 1A, the contact between second coating 24 on blade tip 20 and first coating 18 may be intentional for at least some of the temperatures experienced by blade track 12 and blade 14. For example, gas turbine blade 14 may experience thermal expansion when heated to its operating temperature from the temperature when the gas turbine engine is not in use. At the same time, the blade track 12 may also undergo thermal expansion when heated to the operating temperature. The thermal expansion experienced by turbine blade 14 and blade track 12 may result in a change in distance between substrate 16 of blade track 12 and blade tip 20. In some embodiments, the thickness of first coating 18 and/or second coating 24 may be selected such that coated blade tip 20 approximately contacts surface 30 of abradable coating 18 at a low temperature, such as a minimum operating temperature or a temperature of the surrounding environment when the gas turbine engine is not operating.

Furthermore, as previously described, the thickness of abradable coating 18 may also be selected such that when turbine blade 14 and turbine track or turbine shroud 12 are at a maximum operating temperature, blade tip 20 contacts surface 30 of first coating 18 and second coating 24 abrades at least a portion of ceramic outer coating 36 (FIG. 1B), but not to the depth of second bond layer 34. In this manner, first coating 18 may still provide adequate thermal protection to substrate 16 despite that the fact that second coating 24 on blade tip 20 has abraded the portion of first ceramic outer layer 36 corresponding to groove 28. At the least, the thickness of first coating 18 should be such that coated blade tip 20 does not come into direct contact with surface of substrate 16 during operation of gas turbine engine 10.

As described herein, first ceramic coating 18 and second ceramic coating 24 provide a abradable ceramic coating system or "rub tolerant" ceramic coating system that may be applied to the surfaces of components of a high temperature mechanical system. During operation, the ceramic coating system may provide adequate thermal protection to coated components while first coating 18 is abraded or worn away by second coating 24. The abrasive interaction between first and second coating 18 and 24 may provide an intimate fit between the surfaces of the respective coated components, which may increase both power and efficiency of the corresponding high temperature mechanical system.

While embodiments of the present disclosure have primarily been described with respect to the abrasion of first ceramic coating 18 via second coating 24, examples are not limited as such. In some cases, blade tip 20 may be coated with non-ceramic coating which still possesses properties, e.g., hardness, capable of abrading first coating 18 as described. However, the thermal protection offered by such a non-ceramic coating may not be provided to the same degree provided via a ceramic coating. In other cases, blade tip 20 may be uncoated but the properties of substrate 22 may still allow for the abrasion of first ceramic coating 18 during operation of gas turbine engine 10.

Furthermore, while first ceramic coating 18 was described in terms of ceramic outer layer 36 being adhered to substrate 16 via first and second bond layer 32 and 24, examples are not limited as such. For example, first ceramic coating 18 may include more than two discrete bond layers consistent with the properties and structure of the two bond layer described, e.g., such that the bond layer porosity generally increases moving from the substrate interface to the interface with ceramic outer layer 36, and the outer bond layer provides rough surface for ceramic outer layer 36 to adhere to. In some examples, first ceramic coating 18 may include only a single bond layer in which the properties are varied or graded via deposition techniques such that porosity of bond layer nearest the ceramic outer layer 36 is greater than the porosity of the bond layer nearest the substrate, and provides rough surface for ceramic bond layer 36 to adhere to. Similarly, second coating 24 may include more than one discrete metallic bond layer provided that the combination of bond layers suitably adheres second ceramic outer layer 40 to substrate 22.

Furthermore, although the ceramic layers 36 and 40 are described as outer layers, the respective ceramic layers may be considered outer layers to the extent they are separated from substrate via one or more bond layers. It is recognized that in some embodiments, the ceramic layers may not be outer layer in the sense that one or more other layers may be provided on top of the ceramic layer for one or more reasons so long as the additional outer layers do not prevent interaction between the ceramic layers, e.g., abrasion of first ceramic with second ceramic, as described herein.

EXAMPLE

Figure 2:
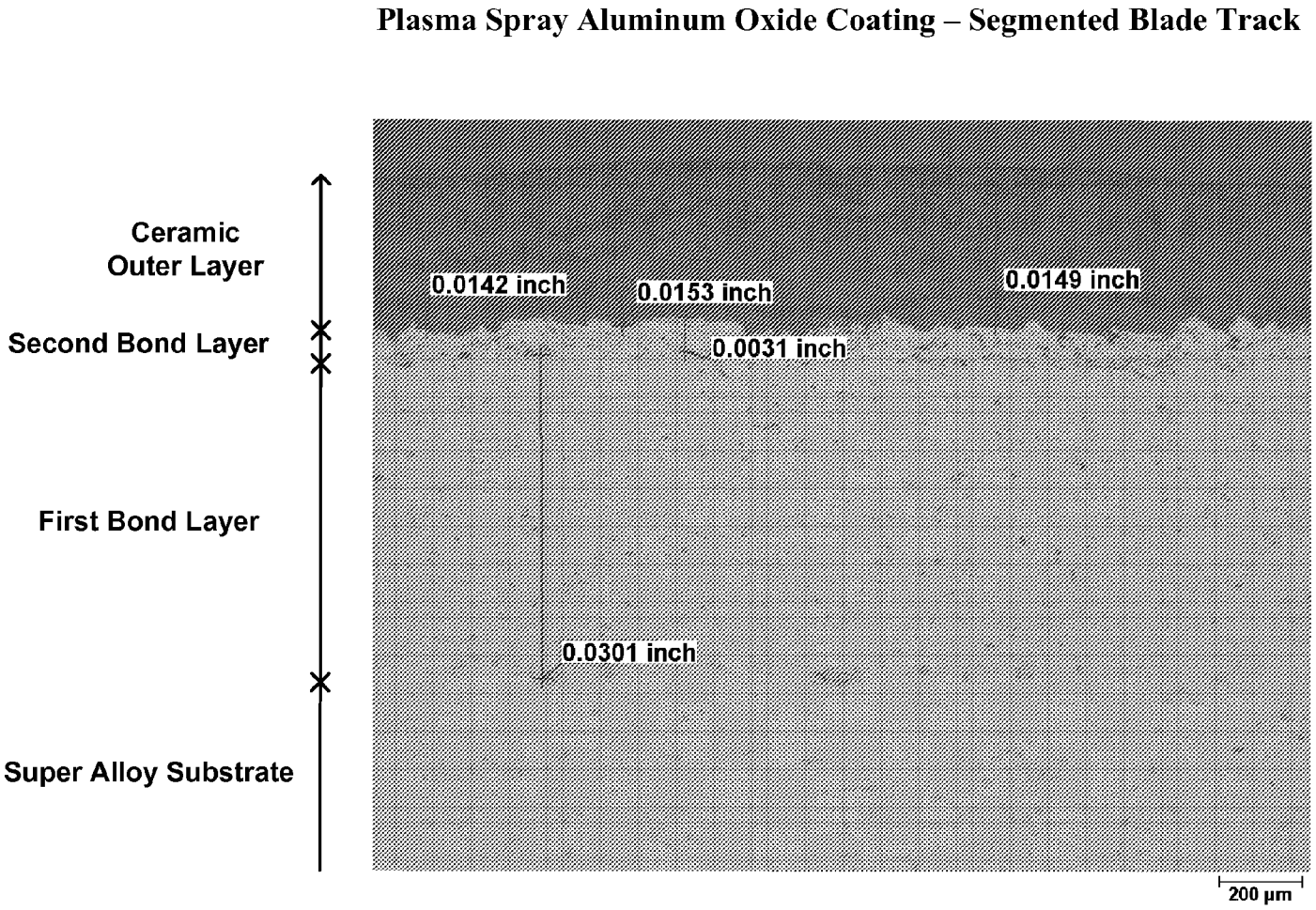
FIG. 2 is a cross-sectional photograph of a portion of a blade track including a superalloy substrate coated with an example ceramic coating according to one example of the disclosure.

FIG. 2 is a cross-sectional photograph of a portion of a blade track including a superalloy substrate coated with an example ceramic coating according to one example of the disclosure. As shown, the ceramic coating includes first and second bond layers and a porous ceramic outer layer. The ceramic layer is firmly bonded to the coarse second layer bond coat and the porosity in the ceramic layer allows extended life via improved thermal expansion.

Various embodiments of the invention have been described. These and other embodiments are within the scope of the following claims.

The invention claimed is:

1. A system comprising:

a first coating deposited on a first substrate, the first coating comprising a first non-ceramic bond layer, a second non-ceramic bond layer, and a first ceramic outer layer, wherein the second non-ceramic bond layer is between the first non-ceramic bond layer and the first ceramic outer layer, wherein the first non-ceramic bond layer defines a first porosity and the second non-ceramic bond layer defines a second porosity that is greater than the first porosity; and a second coating deposited on a second substrate, the second coating comprising a third non-ceramic bond layer deposited on the substrate and a second ceramic outer layer deposited on the third bond layer, wherein the second coating is configured to abrade the first coating, and wherein during operation of the system, the second coating abrades the first ceramic outer layer of the first coating.

2. The system of claim 1, wherein the first bond layer, the second bond layer and the third bond layer each comprise at least one of an MCrAlY alloy (where M is Ni, Co, or NiCo), a β-NiAl nickel aluminide alloy, or a γ-Ni+γ'-$Ni_3Al$ nickel aluminide alloy.

3. The system of claim 1, wherein the first substrate comprises one of a turbine shroud or turbine blade track, and the second substrate comprises one of a turbine vane or turbine blade.

4. The system of claim 1, wherein the composition of the first bond layer is substantially the same as the second bond layer.

5. The system of claim 1, wherein the first porosity is between approximately 5 percent and approximately 20 percent less than the second porosity.

6. The system of claim 1, wherein the second bond layer defines a surface roughness of approximately 350 microinches to approximately 400 microinches.

7. The system of claim 1, wherein a first hardness of the first ceramic outer layer is less than the second hardness of the second ceramic outer layer.

8. The system of claim 7, wherein the first hardness of the first ceramic outer layer is between approximately 35 to approximately 45 Rockwell hardness (Rc).

9. The system of claim 1, wherein the first coating has a first thickness greater than approximately 50 mils.

10. The system of claim 1, wherein the first ceramic outer layer is deposited directly on the second bond layer.

11. The system of claim 1, wherein the first and second substrate each comprise a superalloy.

12. The system of claim 1, wherein the first non-ceramic bond layer, the second non-ceramic bond layer and the third non-ceramic bond layer each comprise a metallic bond layer.

13. The system of claim 1, wherein the first non-ceramic bond layer is directly on the first substrate and the second non-ceramic bond layer is directly on the first non-ceramic bond layer.

14. The system of claim 1, wherein the first porosity of the first non-ceramic bond layer ranges from approximately 1 percent to approximately 10 percent, and the second porosity of the second non-ceramic bond layer ranges from approximately 10 percent to approximately 30 percent.

15. A method for forming a system, the method comprising:

forming a first coating on a first substrate, the first coating comprising a first non-ceramic bond layer, a second non-ceramic bond layer, and a first ceramic outer layer, wherein the first non-ceramic bond layer defines a first porosity and the second non-ceramic bond layer defines a second porosity that is greater than the first porosity, wherein the second non-ceramic bond layer is between the first non-ceramic bond layer and first ceramic outer layer; and forming a second coating on a second substrate, the second coating comprising a third non-ceramic bond layer deposited on the substrate and a second ceramic outer layer deposited on the third bond layer, wherein the second coating is configured to abrade the first coating, and wherein during operation of the system, the second coating abrades the first ceramic outer layer of the first coating.

16. The method of claim 15, wherein the first bond layer, the second bond layer and the third bond layer each comprise at least one of an MCrAlY alloy (where M is Ni, Co, or NiCo), a β-NiAl nickel aluminide alloy, or a γ-Ni+γ'-$Ni_3Al$ nickel aluminide alloy.

17. The method of claim 15, wherein the first substrate comprises one of a turbine shroud or turbine blade track, and the second substrate comprises one of a turbine vane or turbine blade.

18. The method of claim 15, wherein the composition of the first bond layer is substantially the same as the second bond layer.

* * * * *